United States Patent [19]

Ohm

[11] 4,343,004

[45] Aug. 3, 1982

[54] BROADBAND ASTIGMATIC FEED ARRANGEMENT FOR AN ANTENNA

[75] Inventor: Edward A. Ohm, Holmdel, N.J.

[73] Assignee: Bell Telephone Laboratories, Incorporated, Murray Hill, N.J.

[21] Appl. No.: 209,944

[22] Filed: Nov. 24, 1980

[51] Int. Cl.[3] ..... H01Q 19/19; H01Q 19/195

[52] U.S. Cl. ..... 343/781 P; 343/914

[58] Field of Search ..... 343/781 R, 781 P, 781 CH, 343/909, 914

[56] References Cited

U.S. PATENT DOCUMENTS

| | | | |
|---|---|---|---|
| 3,146,451 | 8/1964 | Sternberg | 343/753 |
| 3,569,975 | 3/1971 | Fretz | 343/781 |
| 3,688,311 | 8/1972 | Salmon | 343/755 |
| 3,737,909 | 6/1973 | Bartlett et al. | 343/755 |
| 3,792,480 | 2/1974 | Graham | 343/781 |
| 3,821,746 | 6/1974 | Mizusawa | 343/781 |
| 3,828,352 | 8/1974 | Drabowitch et al. | 343/837 |
| 3,922,682 | 11/1975 | Hyde | 343/761 |
| 3,995,275 | 11/1976 | Betsudan et al. | 343/781 |
| 4,145,695 | 3/1979 | Gans | 343/779 |
| 4,224,626 | 9/1980 | Sternberg | 343/911 |

OTHER PUBLICATIONS

OHM et al.; Numerical Analysis of Multiple-Beam Offset Cassegrainian Antennas; AIAA/CHSI Conf., Apr. 5-8, 1976.

*Primary Examiner*—Eli Lieberman

*Attorney, Agent, or Firm*—Erwin W. Pfeifle

[57] ABSTRACT

The present invention relates to an antenna arrangement capable of correcting for astigmatism over a broadband range, the antenna arrangement comprising a main focusing reflector arrangement (10), such as, for example, a Cassegrainian antenna system, a feed arrangement (12) and an astigmatic correction means (14) disposed between the feed arrangement and the main focusing antenna arrangement. The astigmatic correction means comprises a first and a second doubly curved subreflector (18, 16) which are curved in orthogonal planes to permit the launching or reception of an astigmatic beam of constant size and shape over a broadband range. By proper choice of the angle of incidence at each subreflector, cross-polarization and astigmatism of the beam can be canceled simultaneously.

2 Claims, 5 Drawing Figures

BROADBAND ASTIGMATIC FEED ARRANGEMENT FOR AN ANTENNA

BACKGROUND OF THE INVENTION

1. Field of the Invention

The present invention relates to a broadband astigmatic feed arrangement for an antenna and, more particularly, to a broadband astigmatic feed arrangement comprising a first and a second doubly curved subreflector which are curved in orthogonal planes to permit the launching of an astigmatic beam of constant size and shape over a broadband frequency range. Additionally, the proper angular interpositioning of both reflectors can enable substantial elimination of cross-polarization coupling.

2. Description of the Prior Art

Except for possibly the axial beam of an antenna, reflectors generally will introduce some sort of aberration if the feedhorn is located away from the geometrical focus. Consequently, the wavefront of an off-axis beam is not planar. This is especially true in a multibeam reflector antenna system. Antenna systems, however, have been previously devised to correct for certain aberrations which have been found to exist.

U.S. Pat. No. 3,146,451 issued to R. L. Sternberg on Aug. 25, 1964 relates to a microwave dielectric lens for focusing microwave energy emanating from a plurality of off-axis focal points into respective collimated beams angularly oriented relative to the lens axis. In this regard also see U.S. Pat. No. 3,737,909 issued to H. E. Bartlett et al. on June 5, 1973.

U.S. Pat. No. 3,569,795 issued to G. C. Fretz, Jr. on Mar. 9, 1971 relates to apparatus for altering an electromagnetic wave phase configuration to a predetermined nonplanar front to compensate for radome phase distortion and which wave, upon exiting the radome, has a phase front which is planar.

Other antenna system arrangements are known which use subreflectors and the positioning of feedhorns to compensate for aberrations normally produced by such antenna systems. In this regard see, for instance U.S. Pat. Nos. 3,688,311 issued to J. Salmon on Aug. 29, 1972; 3,792,480 issued to R. Graham on Feb. 12, 1974; and 3,821,746 issued to M. Mizusawa et al. on June 28, 1974.

U.S. Pat. No. 3,828,352 issued to S. Drabowitch et al. on Aug. 6, 1974 relates to microwave antennas including a toroidal reflector designed to reduce spherical aberrations. The patented antenna structure comprises a first and a second toroidal reflector centered on a common axis of rotation, each reflector having a surface which is concave toward that common axis and has a vertex located in a common equatorial plane perpendicular thereto.

U.S. Pat. No. 3,922,682 issued to G. Hyde on Nov. 25, 1975 relates to an aberration correcting subreflector for a toroidal reflector antenna. More particularly, an aberration correcting subreflector has a specific shape which depends on the specific geometry of the main toroidal reflector. The actual design is achieved by computing points for the surface of the subreflector such that all rays focus at a single point and that all pathlengths from a reference plane to the point of focus are constant and equal to a desired reference pathlength. The Hyde subreflector, however, (a) only corrects for on-axis aberration of the torus (similar to spherical aberration), (b) only compensates for aberrations when positioned in the far field of the feed, and (c) can be used to produce offset beams in only one plane.

U.S. Pat. No. 4,145,695 issued to M. J. Gans on Mar. 20, 1979 relates to launcher reflectors which are used with reflector antenna systems to compensate for the aberration of astigmatism which was found to be introduced in the signals being radiated and/or received at the off-axis positions. A major portion of such phase error is corrected by using, with each off-axis feedhorn, an astigmatic launcher reflector having a curvature and orientation of its two orthogonal principal planes of curvature which are chosen in accordance with specific relationships, the launcher reflector being fed by a symmetrical feedhorn.

Prior art arrangements, however, have only compensated for astigmatism introduced by off-axis position of a reflector over a certain band of frequencies. The problem, therefore, remaining is to provide feed arrangements for the correction of astigmatism in off-axis fed reflector antennas over a broad band of frequencies.

SUMMARY OF THE INVENTION

The foregoing problem has been solved in accordance with the present invention which relates to a broadband astigmatic feed arrangement for an antenna and, more particularly, to a broadband astigmatic feed arrangement comprising a first and a second doubly curved subreflector which are each curved in orthogonal planes to permit the launching of an astigmatic beam of constant size and shape over a broadband frequency range. Additionally, the proper angular interpositioning of both reflectors can also enable substantial elimination of cross-polarization coupling.

It is an aspect of the present invention to provide a broadband antenna system capable of correcting for astigmatism in a beam which is launched or received by the antenna system. The antenna system comprises a main focusing reflector and a feed arrangement including a feed capable of launching or receiving a beam of electromagnetic energy and an astigmatic correcting means. The astigmatic correcting means comprises a first reflector disposed between the feed and the main focusing reflector along the feed axis of the beam comprising a radius of curvature in two orthogonal principal planes according to the relationships $$r_1(\perp) = 2f_1(\perp)\cos\theta \text{ and } r_1(\|) = \frac{2f_1(\|)}{\cos\theta}$$

where $r_1(\|)$ is the radius of curvature of said first reflector in the plane of incidence, $r_1(\perp)$ is the radius of curvature of said first reflector perpendicular to the plane of incidence, $\theta$ is the angle of incidence of the beam in either of the associated principal planes, and $f_1$ is the focal length of the first reflector in the associated principal plane as defined by $(1/f_1)=(1/R_3)+(1/R_5)$ where $R_3$ is the phase front radius at said first reflector in the associated principal plane and $R_5$ is the phase front radius of the beam reflected from said first reflector in the associated principal plane; and a second reflector disposed between the feed and said first reflector comprising a radius of curvature in two orthogonal principal planes according to the relationships $$r_2(\perp) = 2f_2(\perp)\cos\theta \text{ and } r_2(\|) = \frac{2f_2(\|)}{\cos\theta}$$

where $r_2(\|)$ is the radius of curvature of said second reflector in the plane of incidence, $r_2(\perp)$ is the radius of curvature of said second reflector perpendicular to the plane of incidence, $\theta$ is the angle of incidence of the beam in either of the associated principal planes, and $f_2$ is the focal length of the second reflector in the associated principal plane as defined by $(1/f_2)=(1/R_7)+(1/R_9)$ where $R_7$ is the phase front radius of the beam incident on the second reflector in the associated principal plane and $R_9$ is the phase front radius of the feed in the associated principal plane, and the first and second reflectors are spaced apart a distance such that $\Delta\phi(\perp)-\Delta\phi(\|)$ is approximately zero degrees where each of $\Delta\phi(\perp)$ and $\Delta\phi(\|)$ in the plane of interest is defined by $$\Delta\phi = 180\frac{\Delta z_4}{\lambda}\left(\frac{w_1}{R_1}\right)^2 \text{ degrees,}$$

where $\Delta z_4$ is the longitudinal distance between the beam-waist of the main focusing reflector and the beam-waist location provided by the broadband astigmatic feed arrangement, $\lambda$ is the wavelength of the signal in the beam, $w_1$ is the spot size radius at a reflector of the main focusing reflector immediately after the first reflector along the first axis of the beam, and $R_1$ is the phase front radius at the reflector of the main focusing reflector where $w_1$ is determined. Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
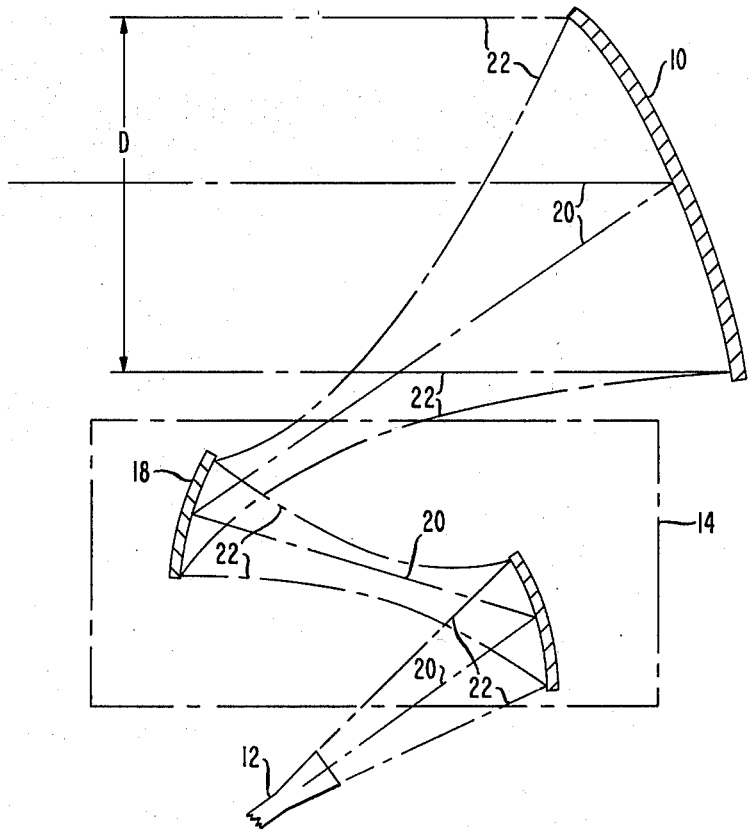
FIG. 1 illustrates an antenna comprising a main reflector, a feedhorn and astigmatic correcting means formed in accordance with the present invention.

FIG. 1 illustrates an offset reflector antenna in accordance with the present invention which comprises a main focusing reflector 10 having an aperture of diameter D, a corrugated feedhorn 12 and a broadband astigmatic correction means 14 comprising a first doubly curved subreflector 18 and a second doubly curved subreflector 16 formed in a manner to be described hereinafter. It is to be understood that the antenna may further include additional subreflectors (not shown), not forming a part of broadband astigmatic corrections means 14, which are disposed between correction means 14 and main reflector 10 along a feed axis 20 of the antenna as is well known in the art. Feed axis 20 can also be realized as the central ray of a beam 22 either radiated by feedhorn 12 to aperture D of main reflector 10 or received at aperture D and reflected to feedhorn 12 via main reflector 10 and subreflectors 18 and 16 of astigmatic correction means 14.

Figure 2:
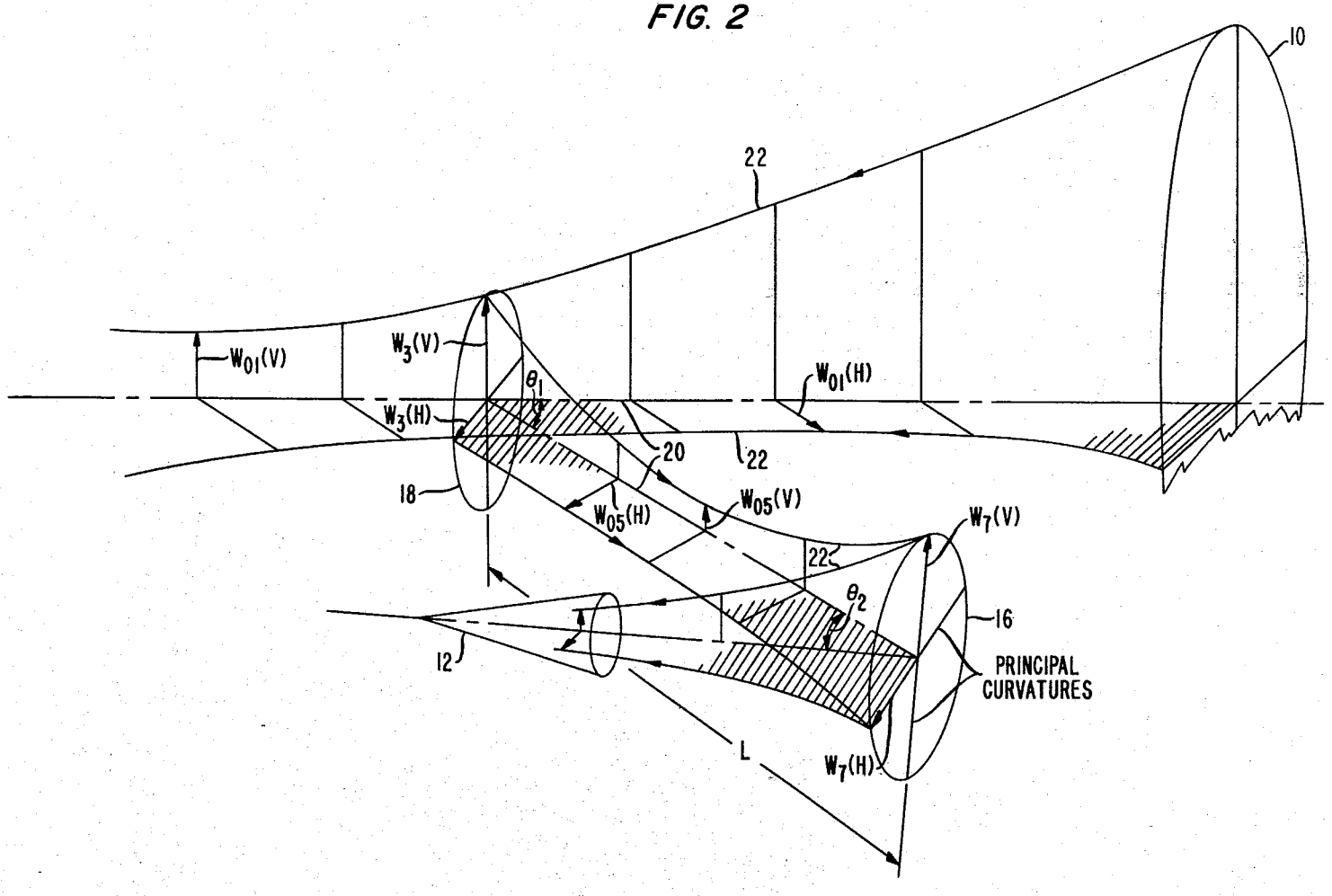
FIG. 2 illustrates typical beam transformations of a beam received by the antenna of FIG. 1 through the astigmatic correction means in accordance with the present invention.

The parameters for a combination of two astigmatic reflectors or lenses which will perform frequency-independent matching between an astigmatic Gaussian field distribution and a circularly symmetric Gaussian field distribution will now be derived. Waists of an astigmatic beam received in the focal region of main reflector 10 are depicted in FIG. 2 as $w_{01}(V)$ and $w_{01}(H)$. These waists lie in orthogonal planes V and H, which are principal planes of the beam, not the vertical and horizontal planes of the antenna. The purpose of the first doubly-curved subreflector 18 in FIG. 2 is to reshape the received beam 22 such that it is circular in cross section upon arrival at subreflector 16. The purpose of subreflector 16 is to superimpose a circularly symmetric phase front, and focus the resulting circularly symmetric beam 22 into feedhorn 12. When a beam is transmitted in the opposite direction, i.e., from feedhorn 12 to aperture D of main reflector 10, at a different frequency than the received beam, it is found that the astigmatic beam waists $w_{01}(V)$ and $w_{01}(H)$ needed by the antenna at the new frequency band are attained by proper choice of the spacing and principal curvatures of subreflectors 16 and 18. Such changes are made while retaining the parameters for optimum reception of the received beam.

It is seen in FIG. 2 that the planes of incidence and principal curvatures of subreflectors 16 and 18 are aligned with the principal planes of beam 22 in all segments of the beam. Consequently, the entire feed beam is characterized by simple rather than general astigmatism. Therefore, beam 22 can be analyzed independently in each principal plane by the use of standard Gaussian-beam equations.

To determine the various antenna parameters in accordance with the present invention for achieving optimum reception of the received beam, the received beam is analyzed in the various regions between reflectors 10, 18 and 16. The received beam 22 appearing at the aperture of main reflector 10 is reflected by reflector 10 to the focal region thereof. In the reflector 10 to its focal region area, the beam's phase-front radius, to be designated $R_1$ hereinafter, and the spot-size radius, to be designated $w_1$ hereinafter, are first determined at reflector 10 for each principal plane of the beam. The reflector 10 to beam-waist distance along the beam 22 axis, to be designated $z_1$ hereinafter, and the beam-waist radius, to be designated $w_{01}$ hereinafter, are then calculated for each principal plane of the beam from:

$$z_1 = \frac{R_1}{1+\left(\frac{\lambda R_1}{\pi w_1^2}\right)^2} \quad (1)$$

$$w_{01} = \frac{w_1}{\left[1+\left(\frac{\pi w_1^2}{\lambda R_1}\right)^2\right]^{\frac{1}{2}}} \quad (2)$$

where $w_1$ and $w_{01}$ are radii of the beam's $1/\epsilon$ amplitude contour, and $\lambda$ is the wavelength.

Using the values of $R_1$ and $w_1$ for main reflector 10, the resulting values for $z_1$ and $w_{01}$ can be determined for a particular wavelength from equations (1) and (2). If, for example, reflector 10 is disposed in the far field of the focal region, it can be found that the size of a given beam waist is essentially proportional to the wavelength and, in contrast, that the longitudinal spacing of the V-plane and H-plane beam waists is independent of wavelength. As wavelength is increased, it is found that beam waists $w_{01}(H)$ and $w_{01}(V)$ in the horizontal and vertical plane, respectively, are both moved toward reflector 10.

As shown in FIGS. 1 and 2, the reflector 10 to its associated focal region beam 22 is intercepted by a subreflector 18 of astigmatic correction means 14. The principal curvatures of subreflector 18, which lie in the vertical and horizontal principal planes, are chosen such that the beam between subreflectors 18 and 16 has a circular symmetrical amplitude upon arrival at subreflector 16. Such symmetry is achieved in three steps. First, the beam 22 spot-size radius, to be designated $w_3$ hereinafter, at subreflector 18, is found from $$w_3 = w_{01}\left[1 + \left(\frac{\lambda z_3}{\pi w_{01}^2}\right)^2\right]^{\frac{1}{2}} \tag{3}$$

where $z_3$ is the distance from beam waist $w_{01}$ to subreflector 18 and $z_3$ is an independent variable. In FIG. 2, for example, $z_3$ is chosen such that subreflector 18 is located approximately halfway between beam waists $w_{01}(V)$ and $w_{01}(H)$. Consequently, subreflector 18 has a compact shape and minimum area. Second, after beam 22 is reflected from subreflector 18, a beam-waist radius, to be designated $w_{05}$ hereinafter, in each of the beam's principal planes is found from $$w_{05} = \frac{w_3}{\sqrt{2}}\left\{1 \pm \sqrt{1 - \left(\frac{2\lambda z_5}{\pi w_3^2}\right)^2}\right\}^{\frac{1}{2}} \tag{4}$$

where $z_5$ is the distance from subreflector 18 to beam-waist $w_{05}$ and is chosen to achieve broadband astigmatic feed performance, as will be described hereinafter. Third, the distance from beam waist $w_{05}$ to subreflector 16 of astigmatic correction means 14, to be designated $z_7$ hereinafter, is found from $$z_7 = \frac{\pi w_{05}^2}{\lambda}\left[\left(\frac{w_7}{w_{05}}\right)^2 - 1\right]^{\frac{1}{2}} \tag{5}$$

where $w_7$ is the beam's spot-size radius at subreflector 16 and is another independent variable. In the preceding steps, a negative value of $z_3$ designates that beam-waist $w_{01}$ is virtual rather than real, i.e., in FIG. 2 $w_{01}(V)$ is located to the left of subreflector 18.

The reflector 10 to focal-region beam incident on subreflector 18 has a phase-front radius, $R_3$, calculated from:

$$R_3 = z_3\left[1 + \left(\frac{\pi w_{01}^2}{\lambda z_3}\right)^2\right] \tag{6}$$

where a negative value for $R_3$ means that beam-waist $w_{01}$ is virtual rather than real. The beam reflected from subreflector 18 has a phase-front radius, $R_5$, which can now be calculated from:

$$R_5 = z_5\left[1 + \left(\frac{\pi w_{05}^2}{\lambda z_5}\right)^2\right] \tag{7}$$

and the subreflector 18 focal length, $f_1$, can, in turn, be found from:

$$(1/f_1) = (1/R_3) + (1/R_5). \tag{8}$$

Once the angle of incidence of subreflector 18 is specified, the surface radius $r_1$ of subreflector 18 in each principal plane can be determined by inserting $f_1$ from Equation (8) into Equation (9) or (10):

$$\frac{1}{f_1(\perp)} = \frac{2\cos\theta}{r_1(\perp)} \tag{9}$$

$$\frac{1}{f_1(\|)} = \frac{2}{r_1(\|)\cos\theta}. \tag{10}$$

The choice of Equation (9) or (10) depends on whether the angle of incidence, $\theta$, is perpendicular or parallel with respect to the principal plane containing $R_3$ and $R_5$.

The subreflector 18 to subreflector 16 beam 22 incident on subreflector 16 has a phase-front radius, to be designated $R_7$ hereinafter, which can be determined from $$R_7 = z_7\left[1 + \left(\frac{\pi w_{05}^2}{\lambda z_7}\right)^2\right]. \tag{11}$$

In accordance with the present invention, the principal curvatures of subreflector 16 are aligned with the principal planes of the subreflector 18 to subreflector 16 beam 22. Once the angle of incidence of subreflector 16 is specified and once the phase front radius, hereinafter to be designated $R_9$, of the feedhorn beam is specified, the subreflector 16 focal length in each principal plane, to be designated $f_2$ hereinafter, and its surface radius in each principal plane, to be designated $r_2$ hereinafter, can be found from:

$$\frac{1}{f_2} = \frac{1}{R_7} + \frac{1}{R_9}, \tag{12}$$

$$\frac{1}{f_2(\perp)} = \frac{2\cos\theta}{r_2(\perp)}, \tag{13}$$

or $$\frac{1}{f_2(\|)} = \frac{2}{r_2(\|)\cos\theta}. \tag{14}$$

The choice of Equation (13) or (14) depends on whether the angle of incidence, $\theta$, is perpendicular or parallel with respect to the principal plane containing $R_7$ and $R_9$.

Figure 3:
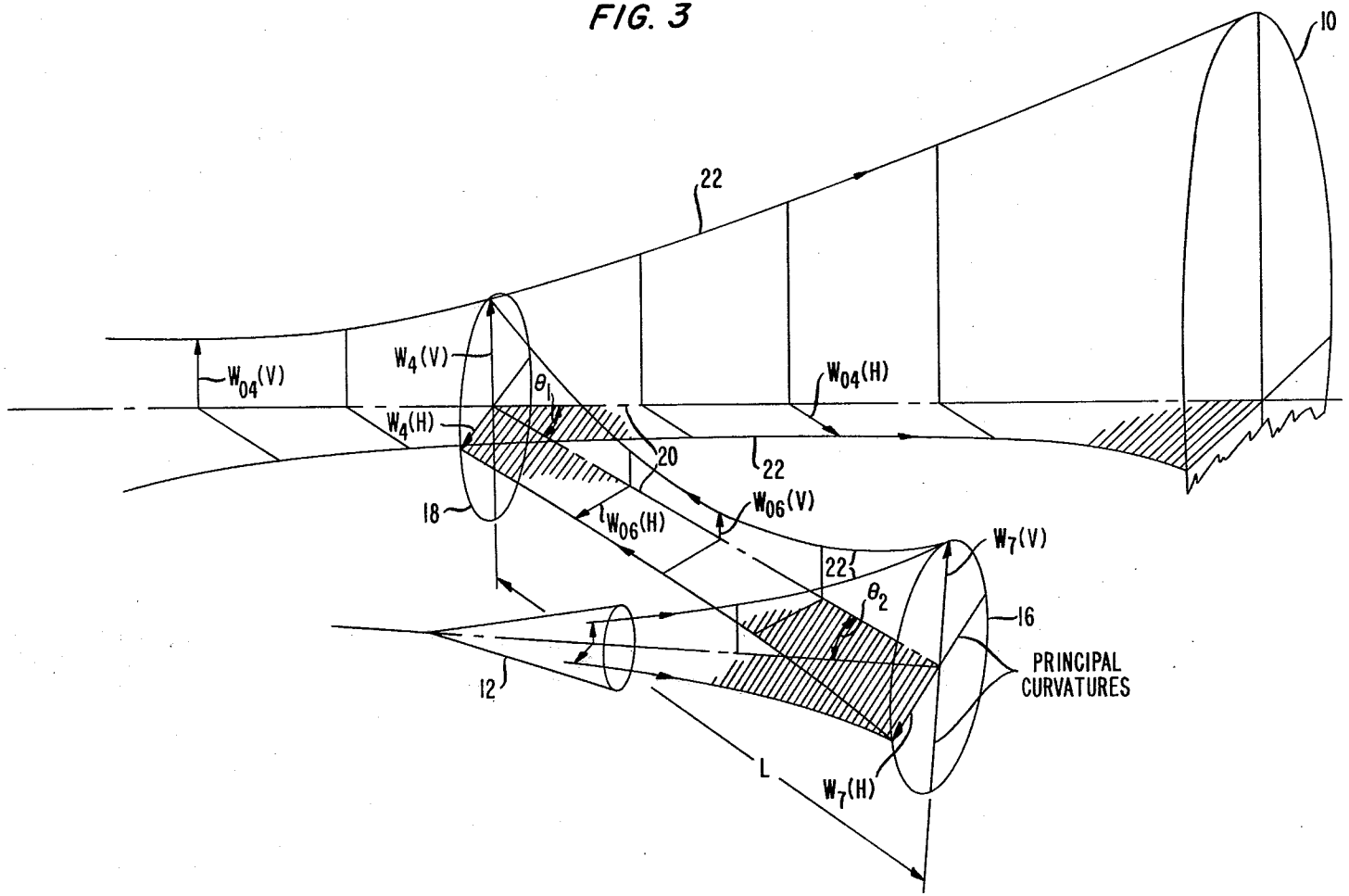
FIG. 3 illustrates typical beam transformation of a beam launched by the antenna of FIG. 1 through the astigmatic correction means in accordance with the present invention.

Having determined the parameters for optimum reception of a received beam through astigmatic correction means 14, it is also desired that the spacing and principal curvatures of subreflectors 16 and 18 be selected to enable the launching of a beam through astigmatic correction means 14 at, for example, a predetermined frequency which may be different from that of the received beam to achieve both optimum reception and transmission conditions. To illustrate how such optimum conditions are achieved once the optimum reception parameters are determined as outlined hereinbefore, it is assumed for analysis purposes, that a beam having the same diameter and the same phase-front radii as the received beam incident on subreflector 16 in FIG. 2 is launched from subreflector 16 in the opposite direction as shown in FIG. 3. It will also be assumed that the wavelength of the launched beam is increased from that of the received beam and will be referred to as $\lambda_1$ hereinafter. This is equivalent to a frequency-independent illumination of subreflector 16 by feedhorn 12 of FIG. 1 where such illumination can be approximated by using a conical corrugated feedhorn.

In FIG. 3, the subreflector 16 to beam-waist $w_{06}$ distance, to be designated $z_8$ hereinafter, and the beam-waist radius in the transmission direction, to be designated $w_{06}$ hereinafter, can be determined from:

$$z_8 = \frac{R_7}{1 + \left(\frac{\lambda_1 R_7}{\pi w_7^2}\right)^2} \tag{15}$$

$$w_{06} = \frac{w_7}{\left[1 + \left(\frac{\pi w_7^2}{\lambda_1 R_7}\right)^2\right]^{\frac{1}{2}}} \tag{16}$$

where $w_7$ is an independent variable and $R_7$ is given by equation (11).

The beam-waist $w_{06}$ to subreflector 18 distance, to be designated $z_6$ hereinafter, can be determined from:

$$z_6 = z_5 + z_7 - z_8. \tag{17}$$

The spot-size radius, to be designated $w_4$ hereinafter, at subreflector 18 can now be determined from:

$$w_4 = w_{06}\left[1 + \left(\frac{\lambda_1 z_6}{\pi w_{06}^2}\right)^2\right]^{\frac{1}{2}}. \tag{18}$$

The transmitted beam 22 incident on subreflector 18 has a phase-front radius, to be designated $R_6$ hereinafter, which can be found from:

$$R_6 = z_6\left[1 + \left(\frac{\pi w_{06}^2}{\lambda_1 z_6}\right)^2\right] \tag{19}$$

while the transmitted beam reflected from subreflector 18 has a phase-front radius, to be designated $R_4$ hereinafter, which can be found from:

$$(1/f_1) = (1/R_6) + (1/R_4). \tag{20}$$

The subreflector 18 to beam-waist $w_{04}$ distance, to be designated $z_4$ hereinafter, and the beam-waist radius, to be designated $w_{04}$ hereinafter, in each of the principal planes can be found from:

$$z_4 = \frac{R_4}{1 + \left(\frac{\lambda_1 R_4}{\pi w_4^2}\right)^2} \tag{21}$$

$$w_{04} = \frac{w_4}{\left[1 + \left(\frac{\pi w_4^2}{\lambda_1 R_4}\right)^2\right]^{\frac{1}{2}}}. \tag{22}$$

Once the dimensions of the transmitted beam 22 are determined from equations (15) through (22) one can determine $z_4$ (optimum) and $w_{04}$ (optimum) values needed by reflector 10 which can be determined from:

$$z_4(\text{optimum}) = z_1 + z_3 - z_2. \tag{23}$$

Furthermore, $w_{04}$ (optimum) is identical to $w_{01}$ calculated using equation (2) for wavelength $\lambda_1$. The error in longitudinal beam-waist location, $\Delta z_4$, is found from:

$$\Delta z_4 = z_4 - z_4(\text{optimum}) \tag{24}$$

where a negative value of $\Delta z_4$ means that beam-waist $w_{04}$ is further than optimum from reflector 10.

It is found that the size of beam-waist radius $w_{04}$ is essentially the same as radius $w_{04}$ (optimum) and $\Delta z_4$ is small compared to the distance from radius $w_{04}$ (optimum)-to-reflector 10. This indicates that residual astigmatism of the transmission beam is small. However, the subreflector 18-to-subreflector 16 spacing, L, defined by $L = z_6 + z_8$ is somewhat different in the vertical and horizontal principal planes. This apparently nonrealizable combination is converted to a practical arrangement by making a minor change in variable $z_5$, with independent variables $z_3$ and $z_7$ being held constant. Such change results in a substantially complete cancellation of residual astigmatism.

To achieve substantial cancellation of such residual astigmatism, either mathematical or graphical techniques can be used in accordance with the present invention. In an exemplary graphical technique, for certain predetermined parameters, $\Delta z_4$ is determined for various values of $z_5$ in each of the two principal planes and the results plotted as shown, for example, in FIG. 4. For those same predetermined parameters, $\Delta z_4$ is also plotted as a function of L as shown, for example, in FIG. 5. In FIG. 5, each length, L, in the area where the two resultant curves lie, corresponds to a realizable feed system. Furthermore, residual astigmatism tends to cancel where the two curves intersect, i.e., where in FIG. 5 $\Delta z_4(V) = \Delta z_4(H) \simeq -4.25$ inches. It will now be shown that such cancellation can be made complete by chosing $\Delta z_4(H)$ to be somewhat larger in amplitude than $\Delta z_4(V)$.

Phase error, $\Delta\phi$, at the edge of reflector 10 due to longitudinal defocus error, $\Delta z_4$, is found from:

$$\Delta\phi = 180\frac{\Delta z_4}{\lambda_1}\left(\frac{w_1}{R_1}\right)^2 \text{ degrees,} \quad (25)$$

where $w_1$ is the spot-size radius and $R_1$ is the phase-front radius both at reflector 10 and $\lambda_1$ is the wavelength of the transmit beam as indicated hereinbefore. Using predetermined values of $w_1$, $R_1$ and $\lambda_1$, $\Delta\phi$ in each of the vertical and horizontal plane can be determined as:

$$\Delta\phi(V)=x_1\Delta z_4(V) \quad (26)$$

$$\Delta\phi(H)=x_2\Delta z_4(H). \quad (27)$$

For zero astigmatism, $\Delta\phi(V)=\Delta\phi(H)$ and by equating equations (26) and (27) and solving for $\Delta z_4(H)$ $$\Delta z_4(H)=(x_1/x_2)\Delta z_4(V) \quad (28)$$

which is the condition for complete cancellation of astigmatism in accordance with the present invention.

If, for example, it is determined that $(x_1/x_2)\simeq 1.411$, in FIG. 5 such condition is essentially satisfied at the points indicated as P and Q. From FIG. 5 at such condition $L\simeq 49$ inches, $\Delta z_4(V)\simeq -3.65$ inches and $\Delta z_4(H)\simeq -5.15$ inches. Inserting such exemplary values into equations (26) and (27) it is found that:

$$\Delta\phi(V)\simeq\Delta\phi(H)\simeq -7.5 \text{ degrees} \quad (29)$$

which is a negligible "defocus" error. This type of error is expected to be negligible in most cases of interest.

Figure 4:
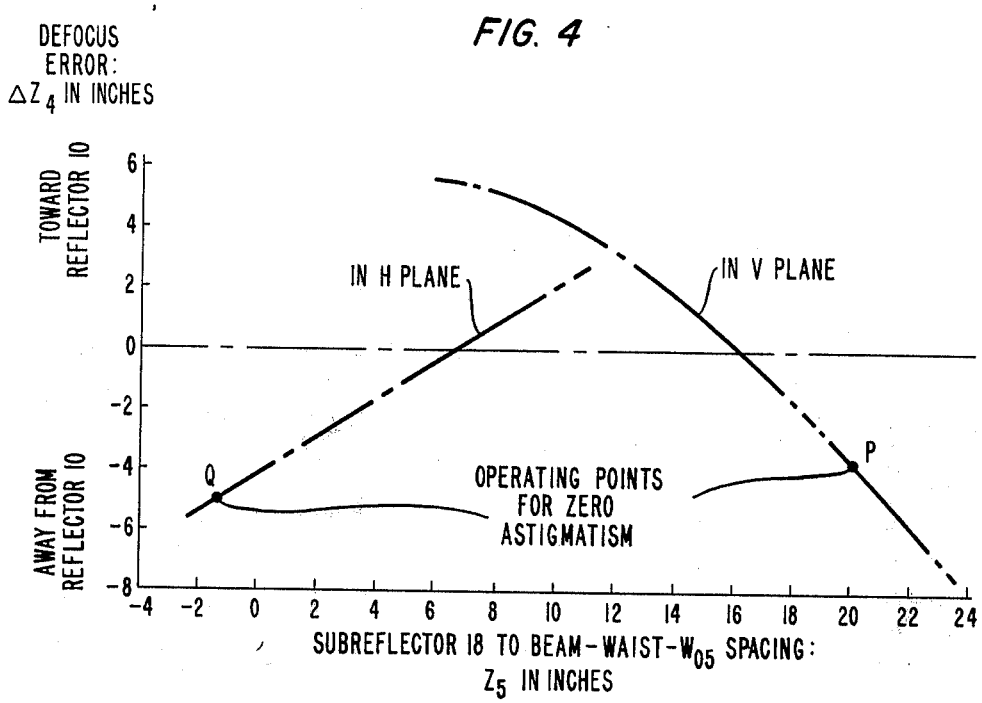
FIG. 4 is a graph of the defocus of the feed versus subreflector 18 to beam-waist $w_{05}$ spacing for both principal planes of a received beam in the astigmatic correction means of FIG. 1.
Figure 5:
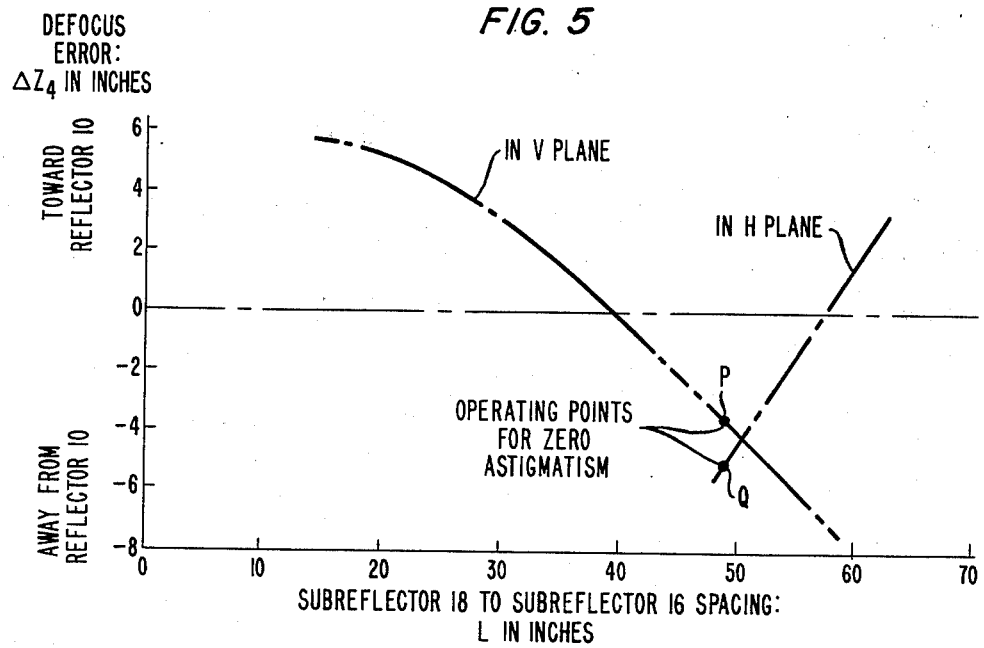
FIG. 5 is a graph of the defocus of the feed versus the subreflector 18 to subreflector 16 spacing for both principal planes of a beam in the astigmatic correction means of FIG. 1.

Points P and Q in FIG. 4 which correspond to P and Q in FIG. 5 show that the optimum values of $z_5$ are, $z_5(V)\simeq 20.1$ inches, and $z_5(H)\simeq -1.5$ inches. A negative value of $z_5$ means that beam-waist $w_{05}$ is virtual rather than real. For example, in FIG. 2, $w_{05}(H)$ is assumed to be real and is, therefore, located on the right of subreflector 18. However, since $w_{05}(H)$ is virtual, it is actually located to the left of subreflector 18. Final dimensions of the two frequency astigmatic feed arrangement can now be found by substituting the new values of $z_5$ for those used previously in equations (4) through (29).

A unique feature of the present astigmatic correction means is that cross-polarization components formed by various elements of the antenna and a stigmatic feed arrangement can be also canceled by the proper selection of $\theta_1$ as a function of $\theta_2$ where $\theta_1$ is the angle of the beam subtended by reflector 10 and subreflector 16 at subreflector 18, and $\theta_2$ is the angle of the beam subtended by subreflector 18 and feedhorn 12 at subreflector 16, as shown in FIGS. 2 and 3. To simultaneously correct for cross-polarization component, due to successive spacings between reflector 10, subreflector 18 and subreflector 16 of FIG. 1, the corresponding phase shifts of the cross-polarized Gaussian-beam mode relative to the dominant Gaussian-beam mode can be determined and plotted in conjunction with the amplitude of each component. By proper selection of the amplitude and phase of the components generated by subreflectors 18 and 16, the vector sum of all components can be made to add to zero. That is, the net cross-polarization of the antenna can be canceled by the proper angular positioning of subreflector 18 and subreflector 16 of astigmatic correction means 14 to achieve the proper $\theta_1$ and $\theta_2$ values.

The foregoing assumes that the principal curvatures of subreflectors 18 and 16 are in alignment with the principal planes of the astigmatic reflector 10-to-focus beam, i.e., as needed to cancel astigmatism. The foregoing also assumes that the peak cross-polarization regions in a cross section of the reflector 10-to-focus beam are essentially in the same plane as those of the anastigmatic feed arrangement shown in FIGS. 2 and 3. Cross-polarization amplitudes generated at subreflectors 18 and 16 can be selected from a range of possible values by proper choice of the angle of incidence, $\theta_i$, at each subreflector. To avoid beam blockage, $\theta_i$ must exceed a certain minimum value, dependent on beam profile. For added flexibility, the sign of a given cross-polarization amplitude can be reversed by use of an equal and opposite value of $\theta_i$. For added phase control, subreflectors 18 and 16 can be redesigned to cancel antenna-beam astigmatism using different values for independent variables $z_3$ and $z_7$. The final design can be chosen from a family of results, where only a single result is depicted in FIGS. 4 and 5. Consequently, the proper vector magnitude and angle for each cross-polarization component formed by each of reflector 10, any subreflector associated with reflector 10 (not shown), and subreflectors 18 and 16 of astigmatic correction means 14 can be selected to simultaneously achieve a net cancellation of cross-polarization vectors. The various components generated by reflector 10 and subreflectors 16 and 18 can be determined using any suitable technique as, for example, outlined in the article "Cross Polarization in Reflector-Type Beam Waveguides and Antennas" by M. J. Gans in *The Bell System Technical Journal*, Vol. 55, No. 3, March 1976, pp. 289–316.

It is to be understood that the above-described embodiments are simply illustrative of the principles of the invention. Various other modifications and changes may be made by those skilled in the art which will embody the principles of the invention and fall within the spirit and scope thereof. For example, $\theta_1$ and $\theta_2$ can be in the other principal plane.

I claim:

1. A broadband antenna system capable of correcting for astigmatism in a beam (22) which is either radiated or received by the antenna system, the antenna comprising:

a main focusing reflector arrangement (10);

a feed arrangement (12) disposed to permit either one of the radiation of the beam in a particular direction and the reception of the beam from a particular direction along a feed axis (20) of the antenna system; and astigmatic correction means (14) disposed to reflect the beam propagating in either direction along the feed axis of the beam between the feed arrangement and the the main focusing reflector arrangement characterized in that the astigmatic correction means comprises:

a first doubly-curved reflector (18) disposed between the feed arrangement and the main focusing reflector arrangement along the feed axis of the beam comprising a radius of curvature in two orthogonal planes according to the relationships $$r_1(\perp) = 2f_1(\perp)\cos\theta \text{ and } r_1(\|) = \frac{2f_1(\|)}{\cos\theta}$$

where $r_1(\|)$ is the radius of curvature of said first reflector in the plane of incidence, $r_1(\perp)$ is the radius of curvature of said first reflector perpendicular to the plane of incidence, $\theta$ is the angle of incidence to the beam in either of the associated principal planes, and $f_1$ is the focal length of the first reflector in the associated principal plane as defined by $(1/f_1)=(1/R_3)+(1/R_5)$ where $R_3$ is the phase front radius at said first reflector in the associated principal plane and $R_5$ is the phase front radius of the beam reflected from said first reflector in the associated principal plane; and a second doubly-curved reflector (16) disposed between the feed arrangement and said first doubly-curved reflector comprising a radius of curvature in two orthogonal planes according to the relationships $$r_2(\perp) = 2f_2(\perp)\cos\theta \text{ and } r_2(\|) = \frac{2f_2(\|)}{\cos\theta}$$

where $r_2(\|)$ is the radius of curvature of said second reflector in the plane of incidence, $r_2(\perp)$ is the radius of curvature of said second reflector perpendicular to the plane of incidence, $\theta$ is the angle of incidence of the beam in either of the associated principal planes, and $f_2$ is the focal length of the second reflector as defined by $(1/f_2)=(1/R_7)+(1/R_9)$ where $R_7$ is the phase front radius of the beam incident on the second reflector in the associated principal plane and $R_9$ is the phase front radius of the feed in the associated principal plane, and the first and second reflectors are spaced apart a distance such that $\Delta\phi(\perp)-\Delta\phi(\|)$ is approximately zero degrees where each of $\Delta\phi(\perp)$ and $\Delta\phi(\|)$ in the plane of interest is defined by $$\Delta\phi = 180\frac{\Delta z_4}{\lambda}\left(\frac{w_1}{R_1}\right)^2 \text{ degrees,}$$

where $\Delta z_4$ is the longitudinal distance between the beam-waist location of the main focusing reflector and the beam-waist location provided by the broadband astigmatic feed arrangement, $\lambda$ is the wavelength of the signal in the beam, $w_1$ is the spot size radius at a reflector of the main focusing reflector arrangement immediately after the first reflector along the feed axis of the beam, and $R_1$ is the phase front radius at the same reflector of the main focusing reflector where $w_1$ is determined.

2. A broadband antenna system in accordance with claim 1 characterized in that the first and second doubly-curved reflectors of the astigmatic correction means are disposed such that the angle of incidence ($\theta$) of the beam in the plane of incidence for each reflector is of a value to produce a net cross-coupling coefficient for the combination of said first and second reflector which is equal in magnitude and opposite in phase to the cross-coupling coefficient produced by the main focusing reflector arrangement for concurrently providing astigmatism and cross-polarization correction.

* * * * *